US006216870B1

(12) United States Patent
Welp

(10) Patent No.: US 6,216,870 B1
(45) Date of Patent: Apr. 17, 2001

(54) PACKAGING FOR A DENTAL X-RAY FILM

(76) Inventor: Ulrich Welp, Römerstrasse 26, Bad Nauheim (DE), D-61231

( * ) Notice: Subject to any disclaimer, the term of this patent is extended or adjusted under 35 U.S.C. 154(b) by 0 days.

(21) Appl. No.: 09/230,732

(22) PCT Filed: Jul. 10, 1997

(86) PCT No.: PCT/DE97/01455

§ 371 Date: May 21, 1999

§ 102(e) Date: May 21, 1999

(87) PCT Pub. No.: WO98/06004

PCT Pub. Date: Feb. 12, 1998

(30) Foreign Application Priority Data

Aug. 3, 1996 (DE) ..... 296 13 485 U
Aug. 27, 1996 (DE) ..... 196 34 539

(51) Int. Cl.[7] ..... B65D 85/48
(52) U.S. Cl. ..... 206/454; 206/455; 383/40
(58) Field of Search ..... 206/454–456, 206/449, 635, 216, 578, 524.1; 378/182, 168; 383/123, 125, 38–40, 93

(56) References Cited

U.S. PATENT DOCUMENTS 3,551,673 * 12/1970 Siegel ..... 206/455
3,621,993 * 11/1971 Kampf ..... 206/455
3,843,041 * 10/1974 Oliverius ..... 206/455
3,941,245 3/1976 Oliverius .
3,941,246 * 3/1976 Duden ..... 206/455
4,831,643 * 5/1989 Tanaka ..... 378/168
4,965,885 10/1990 Fuhrmann .
5,170,423 12/1992 Yurosko .

FOREIGN PATENT DOCUMENTS 44 46 247 6/1996 (DE) .

* cited by examiner

*Primary Examiner*—Luan K. Bui
(74) *Attorney, Agent, or Firm*—Evenson, McKeown, Edwards & Lenahan, P.L.L.C.

(57) ABSTRACT

The invention concerns packaging for a dental x-ray film, comprising a light protective envelope to receive the dental x-ray film, said envelope having two tearaway strips and an envelope which protects against x-rays designed to hold a lead sheet that offers protection against x-rays. The light protective envelope is made from a moisture resistant material. The envelope which protects against x-rays is formed by a pocket on one of the lateral faces of the light protective envelope which is created by an additional side panel and is open on one side.

10 Claims, 2 Drawing Sheets

PACKAGING FOR A DENTAL X-RAY FILM

BACKGROUND OF THE INVENTION

The invention relates to packaging for a dental x-ray film, which has a light-protective envelope to receive a dental x-ray film, said protective envelope being provided with two tear-open strips, and has an x-ray protective envelope for a lead foil protecting against x-radiation.

A package of this kind is subject matter of DE-A-44 46 247. In the package explained in this disclosure the light-protective envelope with the dental x-ray film is disposed in an easily opened x-ray protective envelope. The latter contains at the same time the necessary lead foil. With this packaging it is brought about that the x-ray protective envelope with the lead foil can be used again and again, so that after the x-ray is taken only the light-protective envelope needs to be discarded. The reuse of the x-ray protective envelope does assume that it, like all dental tools, is first disinfected after use and then sterilized in an autoclave, which is often considered to be burdensome.

SUMMARY OF THE INVENTION

In U.S. Pat. No. 5,170,423 there is disclosed a folded light-protective envelope of paper for an x-ray film, wherein the light-protective envelope accommodates a lead film in a projecting tab. The entire system is inserted into a wrapping of plastic which is welded on all sides and has a tear-open strip.

The invention is addressed to the problem of designing a package of the above kind such that it will be convenient to handle and can be made at the lowest possible cost, and in which the material portion that must be disposed of after each use remains as small as possible.

This problem is solved according to the invention in that the light-protective envelope consists of a moisture-resistant material and the x-ray protective envelope is formed by a pocket of the light-protective envelope, said pocket being provided on one lateral surface of the said light-protective envelope and is formed by an additional wall surface and opens to one side.

Such a package can be made very cheaply, because it consists of only three layers of material. Two of them are joined together on all sides and enclose the dental x-ray film in a light-tight manner. The third layer of material forms the pocket for the lead foil. The lead foil can be inserted into it before each x-ray photograph and removed from it after the x-ray. Thus the lead foil can be used again and again, so that only the light-protective envelope with the pocket attached to it needs to be discarded. It is also possible to insert several lead foils into the pocket if an especially great protection against radiation is desired.

Contact with the lead upon insertion of the lead foil into the pocket and removing it can be prevented in a simple manner by enclosing the lead film in a temperature and liquid-resistant wrapper of plastic, polypropylene, for example, being especially advantageous as a material for this wrapper, because it withstands the temperatures required in autoclaving. The wrapper can be configured as a pocket or as a coating of a temperature-resistant plastic.

It is especially advantageous if, according to another embodiment of the invention the outer wall surface of the pocket for the lead foil consists of a transparent material. It is thus possible to see at a glance on which side the lead foil is situated, so that it is assured, when an x-ray photograph is taken, that the lead foil is on the side facing away from the x-ray machine.

The package can be manufactured especially cheaply if it consists of polyethylene or polypropylene.

Opening the light-protective envelope is especially easy if tear-open strips are formed on it in a known manner. The tear-open strips, according to an especially advantageous embodiment of the invention are given a dual function, and serve additionally to make the pocket to open toward one side. For this purpose a preferred embodiment can be characterized by the fact that the tear-open strips fold down against one lateral face of the light-protective envelope and are joined to the lateral face on two sides to form the pocket.

Alternatively, however, it is also possible for the tear-open strips to fold against opposite lateral faces of the light-protective envelope, and to be joined to the particular lateral face. Thus one pocket open at the top is formed on two opposite sides. Therefore it is possible to insert a second x-ray film in the pocket that does not contain the lead foil, so that the package of the invention can also be used for double photographs.

The invention admits of various embodiments. Two of them are represented schematically in the drawing and are described below. The drawing shows in

DESCRIPTION OF THE PREFERRED EMBODIMENTS

Figure 1:
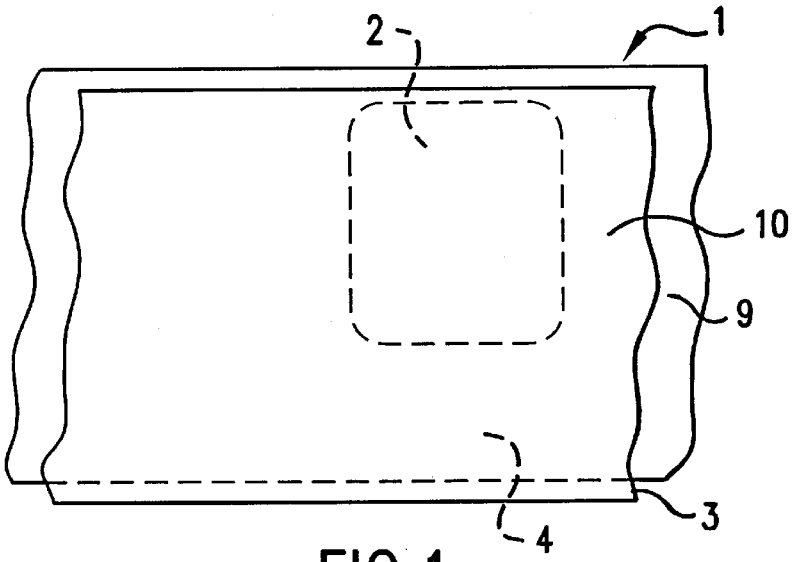
FIG. 1 is a front view of a first embodiment of the package of the instant invention after the first production step.

FIG. 1 shows two superimposed sheets 9 and 10 with a dental x-ray film 2 inserted. This can be a single film that is folded over at the top to form the superimposed sheets 9 and 10. It is also possible, however, to weld two separate sheets together. The areas of sheets 9 and 10 which extend downward beyond the dental x-ray film 2 form tear-open strips 3 and 4 as also shown in FIG. 2.

Figure 3:
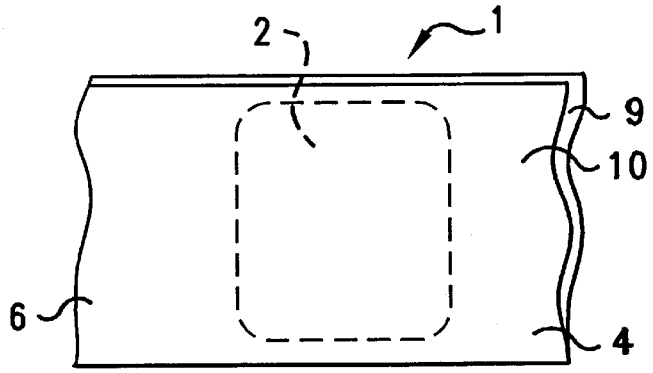
FIG. 3 is a front view of a first embodiment of the package of the instant invention after the second production step.
Figure 4:
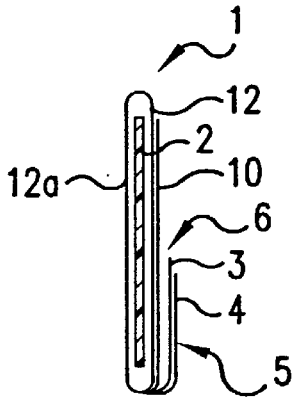
FIG. 4 is a vertical section through the package of FIG. 3.

In FIGS. 3 and 4 it is shown that the tear-open strips 3 and 4 are folded together 180° until they lie against the sheet 10, which forms a side surface 12 shown in FIG. 4. Then a welding is performed so that the tear-open strips 3 and 4 are welded to the sheet 10 and the latter is welded around the dental x-ray film 2 to the sheet 9 at adhesion point 8.

Figure 5:
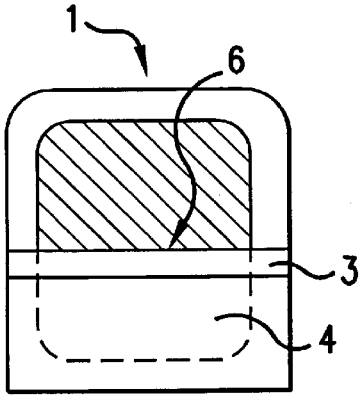
FIG. 5 is a front elevational view of the finished package of FIGS. 1 to 4.
Figure 6:
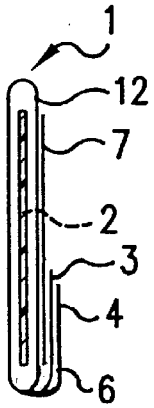
FIG. 6 is a vertical section through the package of FIG. 5.

FIGS. 5 and 6 show that a pocket 6 serves to accommodate a lead foil 7 and in this embodiment, depending on the length of the tear-open strips 3 and 4 occupies only a portion of the height of the package. The pocket 6 is open on one side and is produced by an additional wall surface 5, and provided on one lateral surface 12 of the light protective envelope 1.

Figure 2:
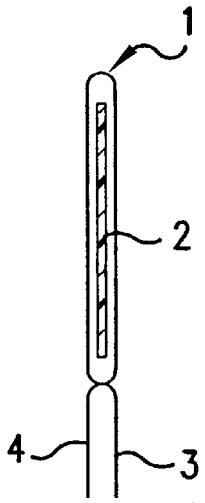
FIG. 2 is a vertical section through the package of FIG. 1.
Figure 7:
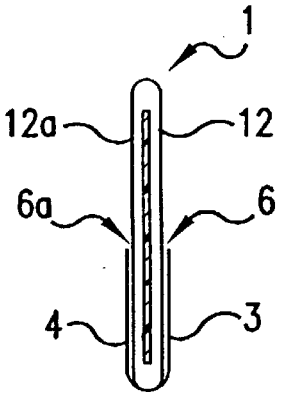
FIG. 7 is a vertical section through the package of a second embodiment of the instant invention.
Figure 8:
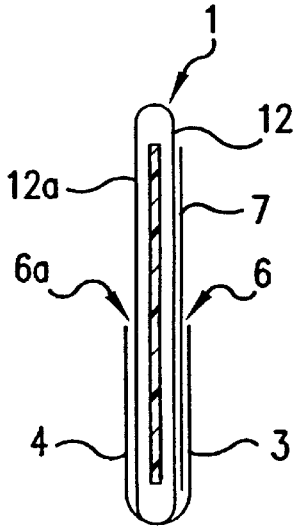
FIG. 8 is a vertical section through the package of a second embodiment of the instant invention showing a lead foil in a pocket.

FIG. 7 shows that the two tear-open strips 3 and 4 can be folded from the position shown in FIG. 2 to different lateral faces 12 and 12*a*. Then a total of two pockets 6 and 6*a*, open at the top, are formed. The upper edge of the individual tear-open strip 3 and 4 can be made to curve convexly upward to enable one to grip it better to tear it open.

What is claimed is:

1. A package for a dental x-ray film, which comprises a light-protective envelope made of a moisture-resistant material having two opposite lateral surfaces and adapted to accommodate a dental x-ray film, and which has an x-ray protective envelope comprising a lead foil holding pocket for protecting against x-rays, and two tear-open strips, folded onto the opposite lateral surfaces of the light-protective envelope and being joined on two sides with said lateral surfaces of the light protective envelope to form two pockets, one of said two pockets forming the pocket for the lead foil, wherein an outer wall surface of the lead foil holding pocket comprises a transparent material.

2. A package according to claim 1, wherein said package is made of polyethylene or polypropylene.

3. In combination, a package for a dental x-ray film, which comprises a light-protective envelope made of a moisture-resistant material having two opposite lateral surfaces and adapted to accommodate a dental x-ray film, and which has an x-ray protective envelope comprising a lead foil holding pocket for protecting against x-rays, and two tear-open strips, folded onto the opposite lateral surfaces of the light-protective envelope and being joined on two sides with said lateral surfaces of the light-protective envelope to form two pockets, one of said two pockets forming the pocket for the lead foil, and a lead foil in said lead foil-holding pocket.

4. A package according to claim 3, wherein the lead foil is enclosed in a temperature resistant and liquid resistant wrapping of plastic.

5. A package according to claim 4, wherein the outer wall surface of the pocket for the lead foil comprises a transparent material.

6. A package according to claim 4, wherein said package is made of polyethylene or polypropylene.

7. A package according to claim 5, wherein said package is made of polyethylene or polypropylene.

8. In combination, a package for a dental x-ray film, which comprises a light-protective envelope made of a moisture-resistant material having two opposite lateral surfaces and adapted to accommodate a dental x-ray film, and which has an x-ray protective envelope comprising a lead foil holding pocket for protecting against x-rays, and two tear-open strips, folded onto the opposite lateral surfaces of the light-protective envelope and being joined on two sides with said lateral surfaces of the light protective envelope to form two pockets, one of said two pockets forming the pocket for the lead foil; a dental x-ray film held within said light-protective envelope; and a lead foil in said lead foil-holding pocket.

9. In combination, a package for a dental x-ray film, which comprises a light-protective envelope made of a moisture-resistant material, said envelope comprising two opposed wall elements adapted to form a dental x-ray film pocket therebetween, said x-ray film pocket being sealed around said x-ray film, said opposed wall elements extending beyond said x-ray film pocket to thereby form a pair of tear-open strips to be used to tear said x-ray film pocket open to remove said x-ray film for processing, said tear-open strips being folded alongside the outer surface of at least one of said wall elements and partially joined thereto to form a lead foil receiving pocket, wherein one of said tear strips is folded alongside the outer surface of one of said wall elements to form said lead foil receiving pocket, and the other of said tear strips is folded alongside the outer surface of the other of said wall elements to form another pocket; and and a lead foil in said lead foil-receiving pocket.

10. In combination, a package for a dental x-ray film, which comprises a light-protective envelope made of a moisture-resistant material, said envelope comprising two opposed wall elements adapted to form a dental x-ray film pocket therebetween, said x-ray film pocket being sealed around said x-ray film, said opposed wall elements extending beyond said x-ray film pocket to thereby form a pair of tear-open strips to be used to tear said x-ray film pocket open to remove said x-ray film for processing, said tear-open strips being folded alongside the outer surface of at least one of said wall elements and partially joined thereto to form a lead foil receiving pocket, wherein one of said tear strips is folded alongside the outer surface of one of said wall elements to form said lead foil receiving pocket, and the other of said tear strips is folded alongside the outer surface of the other of said wall elements to form another pocket; a dental x-ray film held within said dental x-ray film pocket; and a lead foil in said lead foil-receiving pocket.

* * * * *